United States Patent [19]

Nishiyama

[11] Patent Number: 4,971,588

[45] Date of Patent: Nov. 20, 1990

[54] POSITION ADJUSTING METHOD FOR DEFLECTING YOKE

[75] Inventor: Eiichi Nishiyama, Funabashi, Japan

[73] Assignee: Hitachi, Ltd., Tokyo, Japan

[21] Appl. No.: 308,782

[22] Filed: Feb. 9, 1989

[30] Foreign Application Priority Data

Feb. 19, 1988 [JP] Japan ..... 63-35211

[51] Int. Cl.[5] ..... H01J 9/236

[52] U.S. Cl. ..... 445/3

[58] Field of Search ..... 445/3, 4, 63

[56] References Cited

U.S. PATENT DOCUMENTS 3,844,006 10/1974 McGlashan ..... 445/3
4,515,568 5/1985 Cormio ..... 445/3

FOREIGN PATENT DOCUMENTS 0123613 10/1984 European Pat. Off. ..... 445/3
0175619 3/1986 European Pat. Off. ..... 445/3
0013531 1/1986 Japan ..... 445/3
0016449 1/1986 Japan ..... 445/3
0193331 8/1986 Japan ..... 445/3
0622187 8/1978 U.S.S.R. ..... 445/63

*Primary Examiner*—Kurt Rowan
*Attorney, Agent, or Firm*—Antonelli, Terry, Stout & Kraus

[57] ABSTRACT

A position adjusting method for a deflecting yoke of a color cathode-ray tube, where measurng equipment is positioned so that the measuring surface of the equipment is directed upwards, the color cathode-ray tube is positioned so that the panel surface of the tube directs downwards and the panel surface of the color cathode-ray tube is mounted on the measuring surface of the measuring equipment.

6 Claims, 1 Drawing Sheet

POSITION ADJUSTING METHOD FOR DEFLECTING YOKE

BACKGROUND OF THE INVENTION

The present invention relates to a position adjusting method for a deflecting yoke of a color cathode-ray tube applied when the yoke is mounted on the tube, and especially to a position adjusting method comprising a special positioning of a color cathode-ray tube with respect to measuring equipment.

A color cathode-ray tube has, on the inner surface of the panel of the tube, a stripe-shaped or dot-shaped fluorescent surface having colors of green, blue and red arranged in accordance with the slots formed in a shadow mask located in the tube. In mounting a deflecting yoke on the tube, the deflecting yoke is first adjusted in its position relative to the fluorescent surface, and then secured to the tube. The position adjusting process for the yoke includes a luster position adjustment, a purity adjustment and a convergence adjustment. The luster position adjustment is achieved by rotating the yoke around the deflection axis, the purity adjustment is achieved by shifting the yoke relative to the fluorescent surface in the direction of the central axis of deflection, and the convergence adjustment is achieved by shifting the yoke in a plane perpendicular to the central axis of deflection, i.e. parallel to the fluorescent surface of the tube, namely in a plane including X and Y directions as indicated in the drawings. These adjustments run into several dimensions, and require much labor.

In the prior art, a cathode-ray tube is positioned in a state where the panel surface thereof faces in horizontal direction. Then, measuring equipment is attached to the cathode-ray tube, and the position of the yoke is adjusted. This method has problems as described below.

First of the, the adjustment is influenced by earth magnetism. Heretofore, in carrying out a purity adjustment, when an adjustment achieved in the case where the tube panel faces east is selected as a standard adjustment, this standard adjustment is to be confirmed in other situations such as when the panel faces north or south. In this adjusting method, however, the electron beam through the tube is influenced by the vertical magnetic field of the earth, and the positional relation between the electron beam and the fluorescent surface is disturbed.

Secondly, the dielectric strength of the tube against a high voltage becomes a problem. In a color cathode-ray tube having an electron gun of the multi-stage type where a high voltage is applied to each electrode, there is a risk that foreign matter which might exist in the tube may drop into the electron gun when the panel is directed horizontally for an adjustment, thereby deteriorating, due to the foreign matter, the dielectric strength against a high voltage which is applied to the electron gun.

Thirdly, there is a problem with respect to handling of the measuring equipment. In case where the panel surface faces in a horizontal direction, the measuring equipment is required to be pressed against the panel surface where the equipment is to be attached to the panel.

SUMMARY OF THE INVENTION

An object of the present invention is to solve the above-mentioned problems of the prior art.

Another object of the present invention is to provide a position adjusting method for a deflecting yoke which is not influenced by earth magnetism, involves no risk of injury to a cathode-ray tube having a electron gun of a multi-stage type, and facilitates the handling of the measuring equipment.

For achieving the above-mentioned objects, the position adjusting method for a deflecting yoke according to the present invention comprises the steps of positioning a measuring equipment in a position where the measuring surface thereof faces upwards, positioning a color cathode-ray tube on the measuring equipment with the panel surface of the tube facing downwards, and adjusting the position of the deflecting yoke.

DESCRIPTION OF THE PREFERRED EMBODIMENTS

Figure 2:
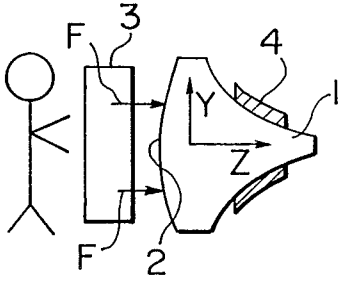
FIG. 2 PRIOR ART
FIG. 2 is a schematic side view showing a prior art method.
Figure 3C:
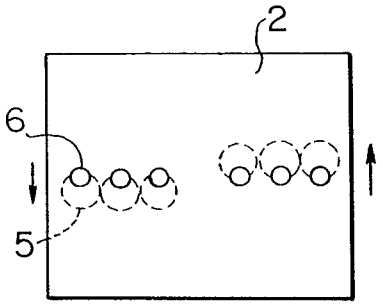
FIGS. 3A, 3B and 3C are front elevations of a panel surface of a color cathode-ray tube of the prior art, each showing various influences of the vertical magnetic field of the earth on electron beams.
Figure 3B:
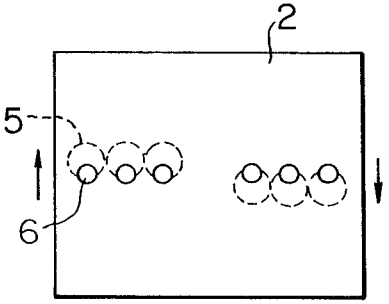
Figure 3A:
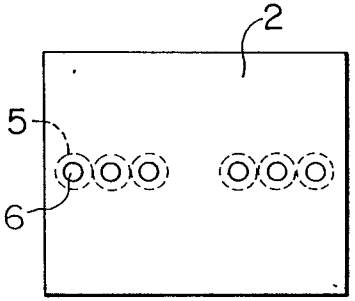

FIG. 2 shows a position adjusting method for a deflecting yoke of the prior art. For adjusting the position of the deflecting yoke 4, a color cathode-ray tube 1 is disposed in a position where the panel 2 of the tube faces in a horizontal direction, and then, measuring equipment 3 is attached to the panel surface 2. Usually, at first, the tube 1 is transferred by transfer means such as a conveyer (not shown) to a position opposite the measuring equipment 3, and then the measuring equipment 3 is shifted towards the tube 1. Next, the relative positions between the tube and the measuring equipment are adjusted with respect to X and Y directions perpendicular to the central axis of deflection, i.e. parallel to the fluorescent surface of the tube, with respect to Z direction parallel to the central axis of deflection, i.e. perpendicular to the fluorescent surface, and with respect to a rotation around the deflection axis. For holding the above-mentioned relative positions constant between the tube 1 and the measuring equipment 3 during the adjusting process in a situation where the panel 2 of the tube 1, faces in a horizontal direction, the measuring equipment 3 is required to be pressed on the panel 2 with a force F. In this situation, the position of the deflecting yoke 4 is adjusted as follows. First of all, a purity adjustment is achieved by adjusting the yoke position relative to the tube 1 mainly in the Z direction in situation where the panel of the tube faces east, and then the adjustment thus obtained is confirmed in the situations where the panel of the tube faces north and south, respectively. FIG. 3A shows a positional relation between fluorescent bodies 6 and electron beams 5 obtained on the panel surface 2 by an adjustment of the tube situation with the panel facing east. This positional relation obtained by the above-mentioned purity adjustment varies as shown in FIGS. 3B and 3C, when the tube is turned for the panel to face north and south, respectively, due to the influence of the vertical magnetic field of the earth magnetism on the electron beams 5. A convergence adjustment includes a static control process (STC) where the deflecting yoke is inactive and a dynamic control process (DYC) where the deflecting yoke is active, and is achieved by shifting the position of the deflecting yoke 4 relative to the tube 1 in X and Y directions passing through the central axis of deflection and by rotating the deflecting yoke in $\theta$ direction around the same central axis (refer to FIG. 1B). A luster position adjustment is achieved by rotating the deflecting yoke in $\theta$ direction around the central axis of deflection.

Figure 1B:
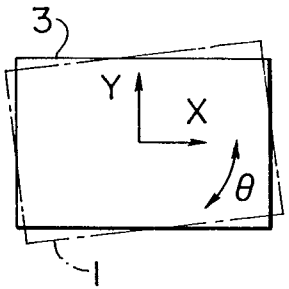
FIG. 1B is a schematic plan view of the configuration shown in FIG. 1A.
Figure 1A:
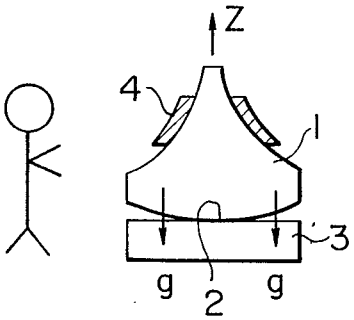
FIG. 1A is a schematic side view showing a configuration for carrying out the present invention.

FIG. 1A shows an arrangement of a tube and a measuring equipment according to the present invention. In FIG. 1, the measuring equipment 3 is fixed in a predetermined position with its measuring surface facing upwards, and the cathode-ray tube is transferred by transfer means (not-shown) such as a conveyer, and mounted on the measuring equipment with the panel 2 of the tube 1 facing downwards. After the position of the tube 1 is adjusted relative to the measuring equipment with respect to X, Y and $\theta$ directions as shown in FIG. 1B, the position of the deflecting yoke 4 will be adjusted relative to the tube 1 in the situation where the tube and the yoke are as shown in FIG. 1A.

A positional adjustment of the yoke 4 carried out with the panel 2 of the tube 1 facing downwards has the following advantages. First of all, the adjustments are not influenced by the vertical magnetic field of the earth. In consequence, the positional relation between a fluorescent body and an electron beam is maintained constant independently of the facing direction of the panel, thereby making it unnecessary to adjust the position of the yoke 4, as in the prior art, in tube situations having specified panel directions. Secondly, since the panel of the tube is facing downwards during adjustment, there is no risk of any foreign matter existing in the tube dropping into the electron gun, which may cause a decrease of the dielectric strength of the tube. Thirdly, since the panel surface 2 of the tube 1 is pressed on the measuring surface of the measuring equipment 3 by virtue of the gravity force g, no other force is required for pressing the panel 2 against the measuring equipment 3, such as required in the prior art as shown by letter F in FIG. 2. Further, since the measuring equipment is fixed, it becomes unnecessary to move the measuring equipment 3 towards the tube 1 and to adjust the position of the measuring equipment relative to the tube 1 in the Z direction.

While the invention has been described in its preferred embodiments, it is to be understood that the invention is not limited thereto but may be variously embodied within the scope of the following claims.

What is claimed is:

1. A method for adjusting the position of a deflecting yoke of color cathode-ray tube through which at least one electron beam passes comprising the steps of:

(a) positioning measuring equipment having a horizontal measuring surface that performs a measurement with the horizontal measuring surface facing upwards;

(b) mounting the color cathode-ray tube on said measuring equipment with an outer panel surface of the color cathode-ray tube facing downwards; and (c) adjusting the position of said deflecting yoke relative to the color cathode-ray tube while the horizontal measuring surface of said measuring equipment is facing upwards and the outer panel surface of the color cathode-ray tube is facing downwards in order to establish a positional relationship between said at least one electron beam and at least one fluorescent body on an inner panel surface of the color cathode-ray tube;

whereby, subsequent to step (c), the established positional relationship between said at least one electron beam and said at least one fluorescent body is unaffected by the vertical magnetic field of the earth when the direction which said outer panel surface of the color cathode-ray tube faces is changed.

2. A method according to claim 1, wherein, subsequent to step (a), said measuring equipment is stationary so that positional adjustment of said measuring equipment relative to the color cathode-ray tube is rendered unnecessary.

3. A method according to claim 1, further comprising the step of automatically measuring a pattern on the panel surface of the color cathode-ray tube with said measuring equipment, said pattern varying in accordance with the adjusting of the position of the deflecting yoke relative to the color cathode-ray tube.

4. A method according to claim 1, wherein the step of mounting the color cathode-ray tube on said measuring equipment results in contact between a center portion of the panel surface of the outer color cathode-ray tube and the measuring surface of said measuring equipment.

5. A method of adjusting the position of a deflecting yoke mounted in relation to a cathode-ray tube through which at least one electron beam passes comprising the steps of:

(a) positioning measuring equipment, comprising a horizontal measuring surface hat performs a measurement, so that the horizontal measuring surface faces upwards;

(b) mounting the cathode-ray tube on said measuring equipment so that an outer panel surface of the cathode-ray tube faces downwards;

(c) adjusting the position of said deflecting yoke relative to the cathode-ray tube while the horizontal measuring surface of said measuring equipment is facing upwards and the outer panel surface of the cathode-ray tube is facing downwards in order to establish a positional relationship between said at least one electron beam and at least one fluorescent body on an inner panel surface of the cathode-ray tube; and (d) automatically measuring a pattern on the outer panel surface of the cathode-ray tube with said measuring equipment, said pattern varying in accordance with the adjusting of the position of the deflecting yoke relative to the cathode-ray tube;

whereby, subsequent to step (c), the established positional relationship between said at least one electron beam and said at least one fluorescent body is unaffected by the vertical magnetic field of the earth when the direction which said outer panel surface of the cathode-ray tube faces is changed.

6. A method of adjusting the position of a deflecting yoke mounted in relation to a cathode-ray tube through which at least one electron beam passes comprising the steps of:

(a) positioning measuring equipment, comprising a horizontal measuring surface that performs a measurement, so that the horizontal measuring surface faces upwards;

(b) mounting the cathode-ray tube on said measuring equipment so that an outer panel surface of the cathode-ray tube faces downwards, step (b) resulting in contact between a center portion of the outer panel surface of the cathode-ray tube and the horizontal measuring surface of said measuring equipment; and (c) adjusting the position of said deflecting yoke relative to the cathode-ray tube while the horizontal measuring surface of said measuring equipment is facing upwards and the outer panel surface of the cathode-ray tube is facing downwards in order to establish a positional relationship between said at least one electron beam and at least one fluorescent body on an inner panel surface of the cathode-ray tube;

whereby, subsequent to step (c), the established positional relationship between said at least one electron beam and said at least one fluorescent body is unaffected by the vertical magnetic field of the earth when the direction which said outer panel surface of the cathode-ray tube faces is changed.

* * * * *